US007090339B2

(12) United States Patent
Sasaki

(10) Patent No.: US 7,090,339 B2
(45) Date of Patent: Aug. 15, 2006

(54) LIQUID DISCHARGE HEAD AND METHOD OF MANUFACTURING THE SAME

(75) Inventor: Keiichi Sasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/058,164

(22) Filed: Feb. 16, 2005

(65) Prior Publication Data

US 2005/0179744 A1 Aug. 18, 2005

(30) Foreign Application Priority Data

Feb. 18, 2004 (JP) ..... 2004-041312

(51) Int. Cl.
*B41J 2/05* (2006.01)

(52) U.S. Cl. ..... 347/65

(58) Field of Classification Search ..... 347/44, 347/47, 54, 56, 62, 63–65, 40; 216/27
See application file for complete search history.

(56) References Cited

U.S. PATENT DOCUMENTS

| | | | | |
|---|---|---|---|---|
| 4,438,191 | A | 3/1984 | Cloutier et al. | |
| 4,905,017 | A * | 2/1990 | Sugitani et al. | 347/65 |
| 5,478,606 | A | 12/1995 | Ohkuma et al. | |
| 6,241,344 | B1 * | 6/2001 | Machida | 347/66 |
| 6,331,259 | B1 | 12/2001 | Ozaki et al. | |
| 6,398,329 | B1 * | 6/2002 | Boyd et al. | 347/7 |
| 6,650,350 | B1 * | 11/2003 | Suzuki et al. | 347/212 |
| 2002/0008740 | A1 * | 1/2002 | Fujii | 347/65 |

FOREIGN PATENT DOCUMENTS

| | | |
|---|---|---|
| JP | 6-286149 | 10/1994 |
| JP | 2000-225708 | 8/2000 |

* cited by examiner

*Primary Examiner*—Shih-Wen Hsieh
(74) *Attorney, Agent, or Firm*—Fitzpatrick, Cella, Harper & Scinto

(57) ABSTRACT

A method of manufacturing a liquid discharge head, comprising the steps of forming a film of an inorganic material in the form of a liquid flow path pattern on a substrate having liquid discharge elements formed thereon, forming a liquid flow path member on the film of the inorganic material using one of silicon oxide, silicon carbide, and carbon doped silicon oxide (SiOC), forming liquid discharge openings in corresponding portions above the liquid discharge elements, and eluting the film of the inorganic material so as to form a liquid flow path.

4 Claims, 4 Drawing Sheets

LIQUID DISCHARGE HEAD AND METHOD OF MANUFACTURING THE SAME

BACKGROUND OF THE INVENTION

1. Field of the Invention

The present invention relates to a liquid discharge head comprising a liquid discharge mechanism and a switching circuit, the liquid discharge head being applicable to an apparatus for use in manufacturing a DNA chip, an organic transistor, a color filter or the like, wherein a liquid is discharged by supplying energy to the liquid discharge mechanism to deposit ink droplets on a medium, and more particularly to an ink jet recording head using ink as a liquid, and a method of manufacturing the same.

2. Description of the Related Art

Ink jet recording heads have been extensively studied as liquid discharge heads. In order to obtain high-quality images using an ink jet recording head, it is desirable to discharge ink droplets from respective discharge openings of the ink jet recording head each in an equal volume and always at the same discharge speed. To mention a single example, there has been disclosed in the specification of Japanese Laid-Open Patent Publication (Kokai) No. 6-286149 (US counterpart: U.S. Pat. No. 5,478,606), a method of manufacturing an ink jet recording head, comprising the steps of forming an ink flow path pattern on a substrate with the use of a dissoluble resin, the substrate having ink ejection pressure generating elements thereon using pressure to eject ink, as ink ejection elements, forming on the dissoluble resin layer a coating resin layer, which will serve as ink flow path walls, forming ink ejection outlets in the coating resin layer above the ink ejection pressure generating elements, and dissolving the dissoluble resin layer, by means of which it is possible to set a short distance between the ink ejection pressure generating element and the discharge opening with very high accuracy and precision as well as good reproducibility, and also to achieve high grade recording.

In this manufacturing method, however, a silicon substrate is used as a substrate for the ink jet recording head and the ink flow path walls are made of resin. Therefore, a deformation can easily occur due to a difference in the linear expansion coefficient between the inorganic material (silicon) and the resin, which constitutes a mechanical problem. Furthermore, when the ink flow path walls are made of resin, generally an edge portion of resin tends to be rounded and the edge of the discharge opening is thus rounded. Because of this, there is a problem that ink droplets do not smoothly separate from the discharge opening. Still further, when the ink flow path walls are made of resin, there is a problem that an adequate dimensional precision cannot always be achieved and a satisfactory reliability cannot always be secured since the ink flow path walls may swell and peel off of the base due to the difference in linear expansion coefficient as stated above.

Therefore, as a means of resolving these problems, there has been suggested in the specification of Japanese Laid-Open Patent Publication (Kokai) No. 2000-225708 (US counterpart: U.S. Pat. No. 6,331,259), a method of manufacturing ink jet recording heads comprising the steps of forming a film of a first inorganic material in the form of an ink flow path pattern using a soluble first inorganic material on a substrate having ink-discharge pressure-generating elements formed thereon, forming a film of a second inorganic material becoming ink flow path walls on the film of the first inorganic material using the second inorganic material, forming ink-discharge openings on the film of the second inorganic material above the ink-discharge pressure-generating elements, and eluting the film of the first inorganic material. This method is intended to resolve the above problems that may occur when the ink flow path walls are made of resin, by using an inorganic material for the ink flow path walls.

This method, however, may present a problem of erosion of the inorganic material caused by ink. Particularly, a silicon nitride (SiN) film is used as a material of the ink flow path walls, which material is eroded by alkaline ink. If an ink jet recording head with a SiN film is continuously used, a change may occur in the width of the ink flow path or the diameter of the ink-discharge opening. Furthermore, even if an ink flow path wall of this kind is protected using a plating material of Ni or the like (see, e.g., U.S. Pat. No. 4,438,191), similar erosion still occurs. This problem is not limited to ink, but may also occur depending on the characteristics of liquids used in fabricating a DNA chip, an organic transistor, a color filter or the like.

Therefore, the present invention provides a liquid discharge head in which of a short distance between a liquid discharge element and a discharge opening may be set with extremely high accuracy and precision as well as good reproducibility without any erosion caused by ink or other liquids, and which is also capable of high grade recording, and a method of manufacturing the same.

SUMMARY OF THE INVENTION

Accordingly, the method of manufacturing the liquid discharge head according to the present invention comprises the steps of: forming a film of an inorganic material in the form of a liquid flow path pattern on a substrate having liquid discharge elements formed thereon; forming a liquid flow path member on the film of the inorganic material using one of silicon oxide, silicon carbide, and carbon doped silicon oxide (SiOC); forming liquid discharge openings in portions corresponding to the liquid discharge elements of the liquid flow path member; and eluting the film of the inorganic material.

In the liquid discharge head manufactured according to the present invention, the liquid flow path member, which forms the discharge openings and the liquid flow paths, is made of silicon oxide, silicon carbide, or SiOC generally used in the semiconductor manufacturing technologies.

Other features and advantages of the present invention will be apparent from the following description taken in conjunction with the accompanying drawings, in which like reference characters designate the same or similar parts throughout the figures thereof.

Figure 1:
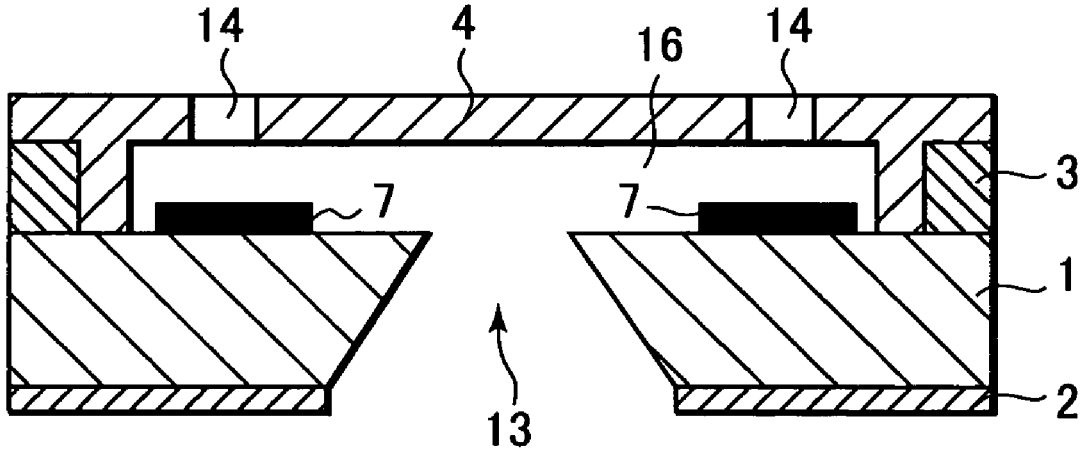
FIG. 1 is a cross section of a side-shooter-type ink jet recording head according to the first embodiment of the present invention.

The accompanying drawings, which are incorporated in and constitute a part of the specification, illustrate embodiments of the invention and, together with the description, serve to explain the principles of the invention.

DESCRIPTION OF THE EMBODIMENTS

A method of manufacturing a liquid discharge head according to the present invention comprises the steps of forming a film of an inorganic material in the form of a liquid flow path pattern on a substrate having liquid discharge elements formed thereon, forming a liquid flow path member on the film of the inorganic material using one of silicon oxide, silicon carbide, and SiOC, forming liquid discharge openings in portions above the liquid discharge elements of the liquid flow path member, and eluting the film of the inorganic material. The silicon oxide, silicon carbide, and SiOC have chemical properties of being insoluble in the solvent (etching solution) used for eluting the film of the inorganic material and being excellent in resistance to ink and other liquids, as well as a physical property of providing mechanical strength satisfactory as a liquid flow path member.

In the liquid discharge head of the present invention, the liquid flow path member, which forms the discharge openings and liquid flow paths, is made of silicon oxide, silicon carbide, or SiOC. These materials for use in the liquid flow path member each have a higher degree of hardness than resin and therefore the liquid flow path member made of any of these materials is not easily deformed. Furthermore, the resistance of these materials to abrasion is relatively high. Therefore, for example, it is possible to increase the durability of the head against wiping of a surface of the discharge openings with a wiping blade at the time of head recovery. Furthermore, since a silicon substrate is generally used as the substrate of the liquid discharge head, the liquid flow path member made of any of the above materials permits a decrease in the difference in thermal expansion between the substrate and the liquid flow path member and thus it can eliminate deformation caused by such a difference in thermal expansion. Still further, these materials, unlike resin, prevent permeation of ink or other liquids, and therefore they may prevent the problem of the liquid flow paths or discharge openings being narrowed due to swelling. Furthermore, in comparison with SiN and Ni, these materials are excellent in resistance to erosion by ink or other liquids, and liquid flow paths made of any of these materials are not easily eroded by ink or other liquids.

It is possible to form liquid discharge openings on a liquid flow path member made of any of these materials by a photolithography process. Therefore, the liquid discharge openings can be formed with a high precision.

Furthermore, the film of the inorganic material can be an Al-based film. If so, phosphoric acid or hydrochloric acid can be used in the step of eluting the film of the inorganic material. Also, it can be a Cu-based film. If so, nitric acid can be used in the step of eluting the film of the inorganic material.

In the liquid discharge head of the present invention, a metallic material layer can be disposed between the substrate and a part of the liquid flow path member. According to this arrangement, a force applied to the metallic material layer by a residual stress that may occur in the liquid flow path member can be offset by a force applied to the liquid flow path member by a residual stress that may occur in the metallic material layer, thereby preventing these forces from reaching the substrate to cause warpage thereof. As a result, the liquid discharge precision can be further improved.

Preferred embodiments of the present invention will now be described with reference to the accompanying drawings, by giving an example of an ink jet recording head.

First Embodiment

The first embodiment of the present invention relates to an ink jet recording head comprising a film of an inorganic material formed in a region for liquid flow paths using Al and an ink flow path member formed using $SiO_2$, and a method of manufacturing the same. The film of the inorganic material serves as a sacrificing layer (a layer for use in forming a discharge opening pattern).

Referring to FIG. 1, there is shown a cross section of a side-shooter-type ink jet recording head according to the first embodiment of the present invention. The side-shooter type is a type of inkjet recording head in which liquid is discharged from above the liquid discharge elements (electrothermal converting elements).

The ink jet recording head of this embodiment has a Si substrate 1 on which electrothermal converting elements 7 as ink discharge pressure generating elements are arranged in two lines at a predetermined pitch. The Si substrate 1 has a through-hole 13 between the two lines of electrothermal converting elements 7. The through-hole 13 is formed by wet-etching the Si substrate 1 using a $SiO_2$ film 2 formed on a lower surface of the Si substrate 1 as a mask. Above the Si substrate 1, discharge openings 14 are formed in a $SiO_2$ film 4 for forming an ink flow path member, so as to correspond to the electrothermal converting elements 7, and an individual ink flow path 16 communicating with the discharge openings 14 is formed from the through-hole 13.

Furthermore, in the ink jet recording head of this embodiment, the $SiO_2$ film 4 forming the ink flow path member on the Si substrate 1 is disposed on an Al film 3 on the Si substrate 1.

The ink jet recording head is arranged so that the surface having the discharge openings 14 is opposed to a recording surface of a recording medium (not shown). The ink jet recording head discharges ink droplets from the discharge openings 14 by applying pressure generated by the electrothermal converting elements 7 to the ink that has flowed into the ink flow path via the through-hole 13, to deposit ink droplets on the recording medium for recording.

The following describes a manufacturing process of the ink jet recording head of this embodiment. Referring to FIGS. 2A to 2H, there are shown diagrams of the manufacturing process of the ink jet recording head of this embodiment.

Figure 2A:
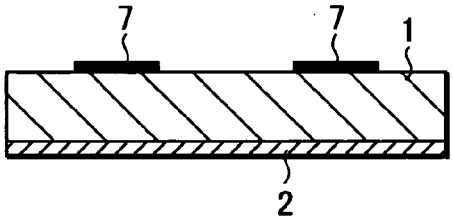
FIGS. 2A–2H are diagrams showing a manufacturing process of the ink jet recording head according to the first embodiment of the present invention.

As shown in FIG. 2A, first, the electrothermal converting elements 7 (heaters made of TaSiN) as discharge energy generating elements are formed on the upper surface of the Si substrate 1. Then, on the electrothermal converting elements 7 and wiring for their electrical connections, a protective film (not shown) for protecting them from ink and a cavitation-proof film (not shown) are formed. For example, a SiN film can be used for the protective film for protecting the heater wires or the like from ink, while a Ta film can be used for the cavitation-proof film. Furthermore, a SiC film (not shown) is formed on the above structure by the plasma CVD method or the like in a thickness of 200 nm. Still further, the $SiO_2$ film 2 is formed on the lower surface of the Si substrate 1 by the plasma CVD method in a thickness of approximately 2 μm under the condition of a temperature of 400° C.

Moreover, a driver IC (not shown) or the like for driving the electrothermal converting elements (heaters) 7 is also formed on the upper surface of the Si substrate 1. The electrothermal converting elements 7, the electric wiring, and the driver IC are protected by the foregoing protective film (for example, a SiN film) and electrically insulated.

Figure 2B:
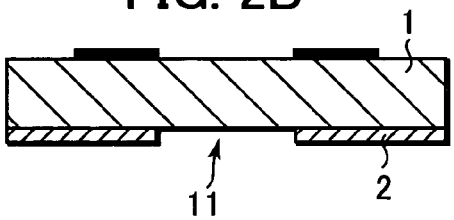

Subsequently, turning to FIG. 2B, a resist (not shown) is applied to the $SiO_2$ film 2. After exposure and development, an opening 11 is then formed on the $SiO_2$ film 2 by means of dry or wet etching. The $SiO_2$ film 2 serves as a mask for forming the through-hole 13 later. The through-hole 13 is formed from the opening 11. If the opening 11 is formed by dry etching, for example, reactive ion etching (RIE) or plasma etching is performed with $CF_4$ as the etching gas. If it is formed by wet etching, buffered hydrofluoric acid is used.

Figure 2C:
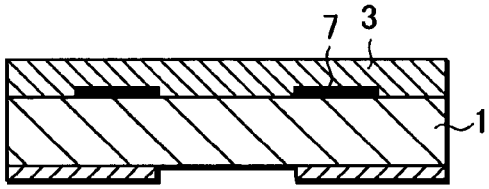

Subsequently, as shown in FIG. 2C, the Al film 3 is formed as a film of an inorganic material by sputtering on the upper surface of the Si substrate 1 in a thickness of approximately 10 μm at a temperature of 150° C. While the Al film 3 is formed at the temperature of 150° C. in this embodiment, it is preferable to form it at a temperature of 450° C. or lower.

Figure 2D:
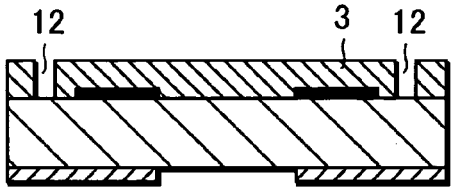

Subsequently, a resist (not shown) is applied to the Al film 3 and patterned by photolithography. As shown in FIG. 2D, the Al film 3 is patterned in the form of the ink flow path 16 (see FIG. 2H) by means of RIE or other dry etching. In this patterning, the openings 12 are formed in the Al film 3. In this embodiment, the protective film (SiN film) and the SiC film have been formed on the Si substrate 1, as stated above. Therefore, the underlying SiC film (not shown) serves as an etching stop layer during etching of the Al film 3, thereby preventing etching of the SiN film as the protective film under the SiC film. Thus, a preferable structure is provided in terms of electrical insulation.

Figure 2E:
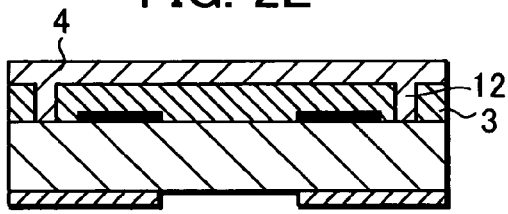

Subsequently, as shown in FIG. 2E, the Al film 3 is patterned and then the resist (not shown) is removed by means of $O_2$ ashing or the like. Thereafter, the $SiO_2$ film 4 is formed on the Al film 3 by the plasma CVD method. In this process of forming the $SiO_2$ film 4, the openings 12 are also filled with the $SiO_2$ film 4. As the plasma CVD gas, TEOS/$O_2$ gas, which is an organic source of the tetraethoxysilane (TEOS) family, is used for good step coverage in the film formation.

While the formation of the $SiO_2$ film 4 by the plasma CVD method has been described in this embodiment, the $SiO_2$ film 4 can be formed by a method other than this method. For example, if the $SiO_2$ film 4 is formed by the TEOS/$O_3$-CVD method, a smoother $SiO_2$ film 4 can be obtained.

Figure 2F:
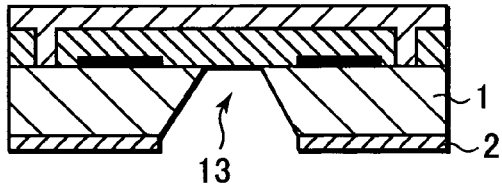

Subsequently, as shown in FIG. 2F, the through-hole 13 serving as an ink supply port is formed in the Si substrate 1, using the previously worked $SiO_2$ film 2 as a mask. While the through-hole 13 can be formed by any method, wet etching is preferred in order to minimize damage to the Si substrate 1.

Figure 2G:
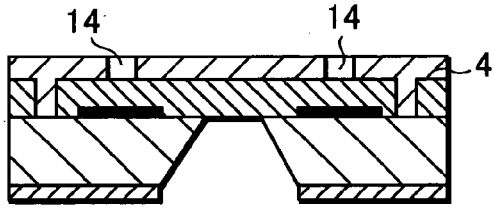

Next, turning to FIG. 2G, for example, a water-repellent film (not shown) made of CFx is formed on the $SiO_2$ film 4 at a temperature of 300 to 400° C. Moreover, resist (not shown) is applied to the top surface thereof and patterned in a predetermined form. Then, the water-repellent film and the $SiO_2$ film 4 are etched by means of dry etching with a fluorinated gas until the Al film 3 is exposed. Thus, the discharge openings 14 are formed above the electrothermal converting elements 7 so as to correspond thereto. Thereafter, the resist is removed using a remover in such a way that the water-repellent film is not damaged. By adopting the highly anisotropic RIE in the process of forming the discharge openings 14, additional advantageous effects are produced as described below.

Specifically, with the conventional structure of the side-shooter-type ink jet recording head, the edge portion of the discharge opening tends to be rounded because the discharge-opening portion is made of resin, and this may adversely affect the discharge characteristics. To avoid this possibility, an orifice plate, which is formed by means of electrocasting, has conventionally been bonded to such an opening portion. According to this embodiment, however, the discharge openings 14 are formed on the $SiO_2$ film 4 by means of RIE, hence making it possible to form the edges of the discharge openings 14 with high precision, minimizing the undesirable roundedness.

Further, with the $SiO_2$ film 4 that has been multi-layered, the etching rate is made higher on the lower part or the composition may be changed gradually. In this manner, it becomes possible to provide an inverse tapered shape to make the exit of each of the discharge openings 14 narrower, while the interior thereof is made wider. With the inversely tapered discharge openings 14, printing accuracy is further enhanced due to the stabilization of the discharge direction of ink droplets discharged from the discharge openings 14. In this regard, $SiO_2$ is superior to silicon nitride (SiN) in resistance to erosion against ink.

Figure 2H:
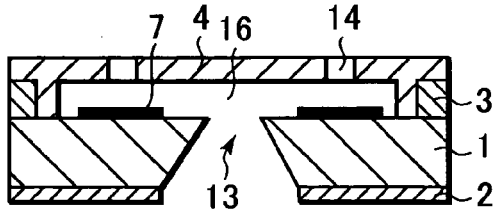

Subsequently, as shown in FIG. 2H, the portion of the Al film 3 located in the region for forming the ink flow path 16 is dissolved and eluted by an etching solution such as phosphoric acid or hydrochloric acid, introduced from the discharge openings 14 and/or the through-hole 13, by means of which the $SiO_2$ film 4 forms the ink flow path 16. Thereafter, an ink supply member (not shown) is bonded to the lower surface of the Si substrate 1 to complete the ink jet recording head.

The $SiO_2$ film 4 is used as a basic material for forming the discharge openings 14 and the ink flow path 16 in this embodiment. The $SiO_2$ film 4 is relatively low in the coefficient of thermal expansion and relatively hard in comparison with resin, thereby being resistant to deformation. In addition, $SiO_2$ is superior to SiN and Ni in resistance to erosion by ink. Moreover, unlike resin, the $SiO_2$ film 4 prevents permeation of ink and therefore does not cause the problem of the liquid flow paths or discharge openings becoming narrowed due to swelling.

Furthermore, according to this embodiment, it is also possible to leave the Al film 3 in regions other than the ink flow path 16 intentionally to use it as a wiring layer. If so, wiring of a low resistance can be formed because the wiring layer made of the Al film 3 is extremely thick. By using this as the power wiring for driving the heaters (the electrothermal converting elements 7), loss of foaming energy caused by the wiring resistance is reduced, thereby making it possible to provide a circuit very effective in energy conservation. Moreover, by leaving the Al film 3 as a metallic material layer in the regions other than the ink flow path 16, a force applied to the Al film 3 by a residual stress in the $SiO_2$ film 4 can be offset by a force applied to the $SiO_2$ film 4 by a residual stress in the Al film 3, thereby preventing these forces from reaching the Si substrate 1 to cause warpage thereof. By virtue of this, the ink discharge precision can be further improved.

As stated hereinabove, according to this embodiment, it is possible to provide an ink jet recording head in which a short distance between the ink discharge pressure generating element and the discharge opening may be set with extremely high accuracy and precision as well as good reproducibility without any erosion caused by ink, and which is also capable of high grade recording, and a method of manufacturing the same.

Second Embodiment

The second embodiment of the present invention relates to an ink jet recording head comprising a film of an inorganic material formed using Cu and an ink flow path member formed using SiC, and a method of manufacturing the same.

Figure 3:
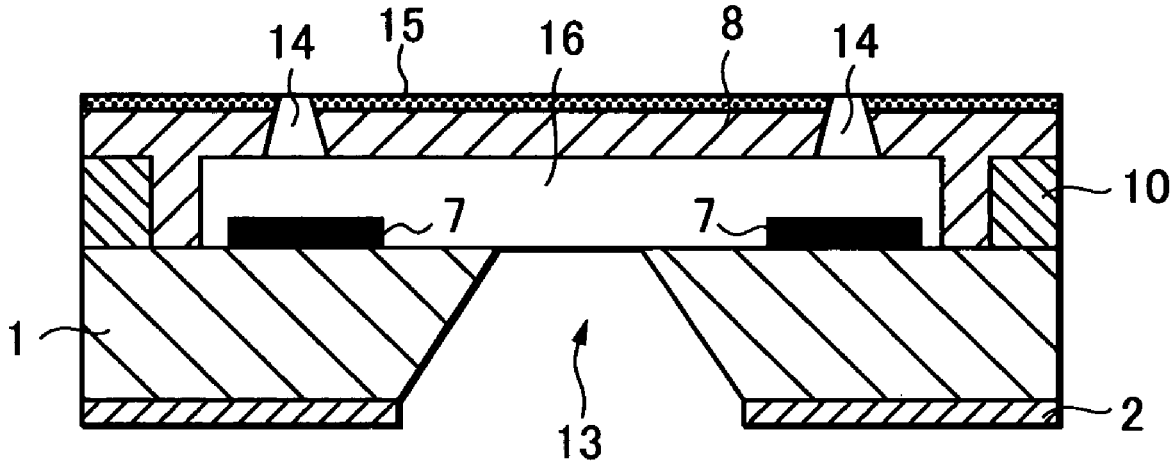
FIG. 3 is a cross section of a side-shooter-type ink jet recording head according to the second embodiment of the present invention.

Referring to FIG. 3, there is shown a cross section of a side-shooter-type ink jet recording head manufactured according to this embodiment. The ink jet recording head of this embodiment is substantially the same as the first embodiment except that Cu is used for the film of the inorganic material and SiC is used as the material of the ink flow path member. Therefore, a detailed description of the structure is omitted here.

The following describes a manufacturing process of the ink jet recording head according to this embodiment. Referring to FIGS. 4A to 4G, there are shown diagrams of the manufacturing process of the ink jet recording head of this embodiment. The portion of the description that is the same as that of the first embodiment will be omitted here.

Figure 4A:
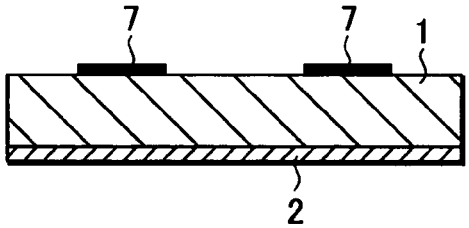
FIGS. 4A–4G are diagrams showing a manufacturing process of the ink jet recording head according to the second embodiment of the present invention.

As shown in FIG. 4A, first, the electrothermal converting elements 7 (heaters made of TaSiN) as discharge energy generating elements are formed on the upper surface of the Si substrate 1. Then, on the electrothermal converting elements 7 and wiring for their electrical connections, a protective film (not shown) for protecting them from ink and a cavitation-proof film (not shown) are formed. A SiC film (not shown) is formed on the above structure by the plasma CVD method or the like in a thickness of 200 nm. Furthermore, the $SiO_2$ film 2 is formed on the lower surface of the Si substrate 1 by the plasma CVD method in a thickness of approximately 2 μm under the condition of a temperature of 400° C.

Moreover, a driver IC (not shown) or the like for driving the electrothermal converting elements (heaters) 7 is also formed on the upper surface of the Si substrate 1. The electrothermal converting elements 7, the electric wiring, and the driver IC are protected by the foregoing protective film (for example, a SiN film) and electrically insulated.

Figure 4B:
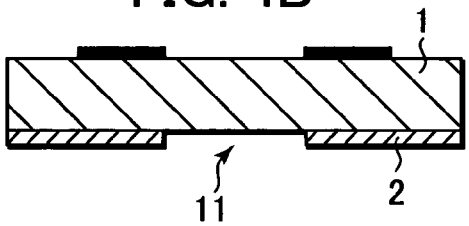

Subsequently, turning to FIG. 4B, a resist (not shown) is applied to the $SiO_2$ film 2. After exposure and development, an opening 11 is then formed on the $SiO_2$ film 2 by means of dry or wet etching. The $SiO_2$ film 2 serves as a mask for forming the through-hole 13 later. The through-hole 13 is formed from the opening 11. If the opening 11 is formed by dry etching, for example, reactive ion etching (RIE) or plasma etching is performed with $CF_4$ as the etching gas. If it is formed by wet etching, buffered hydrofluoric acid is used.

Figure 4C:
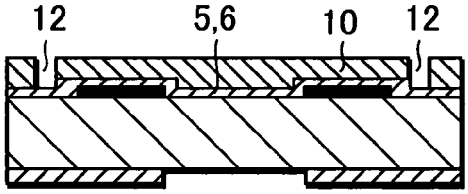

Subsequently, as shown in FIG. 4C, a Ta film 5 is formed by sputtering on the upper surface of the Si substrate 1 in a thickness of 200 to 300 nm and further a Cu film 6 is formed in a thickness of 50 to 100 nm by sputtering thereon. Subsequently, resist (not shown) is applied to the Cu film 6 and patterned in the form of the ink flow path 16. Then, a Cu film 10 made of Cu as a film of an inorganic material, which forms the ink flow path 16, is formed in the form of the ink flow path pattern by electrolytic plating. In this patterning, openings 12 are formed in the Cu film 10. It is preferable to form the Cu film 10 at a temperature of 450° C. or lower.

Figure 4D:
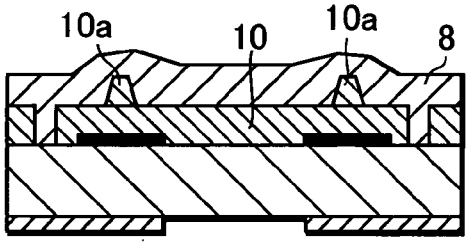

Moreover, turning to FIG. 4D, a resist (not shown) is applied to the Cu film 10 and patterned in the form of patterns of the discharge openings 14 and discharge opening patterns 10*a* made of Cu, which form the discharge openings 14 located above the electrothermal converting elements 7, are formed by electrolytic plating. Subsequently, after removing the resist (not shown), the Cu film 6 (not shown in FIG. 4D or subsequently) in portions exposed to the openings 12 is removed by wet etching using nitric acid. Furthermore, the Ta film 5 (also not shown in FIG. 4D or subsequently) is removed by dry etching such as chemical dry etching (CDE). In etching the Ta film 5, high selectivity to the underlying SiN film is preferable in view of securing the electrical insulation.

Subsequently, with further reference to FIG. 4D, a SiC film 8 is formed on the Cu film 10 and the discharge opening pattern 10*a*. The SiC film 8 can be formed, for example, by the plasma CVD method or the like. In the process of forming the SiC film 8, the openings 12 are also filled with the SiC film 8. Thereafter, the upper surface of the SiC film 8 is planarized by chemical mechanical polishing (CMP) until the top face of the discharge opening pattern 10*a* is exposed. After planarizing the top face of the SiC film 8 as stated above, the top face of the SiC film 8 is etched to a depth of 500 nm by chemical dry etching (CDE) or the like.

Figure 4E:
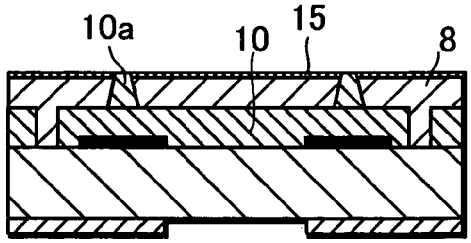

Subsequently, as shown in FIG. 4E, a water-repellent film 15, for example, made of CFx is formed on the SiC film 8 and the discharge opening pattern 10*a* at a temperature of 300 to 400° C. Thereafter, the portion of the water-repellent film 15 on the discharge opening pattern 10*a* is removed by the CMP method.

Figure 4F:
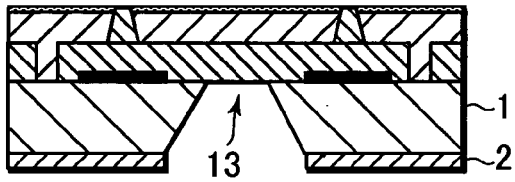

Then, as shown in FIG. 4F, a through-hole 13 serving as an ink supply port is formed in the Si substrate 1, using the previously worked $SiO_2$ film 2 as a mask. While the through-hole 13 can be formed by any method, inductively coupled plasma (ICP) etching using $CF_4$, $C_2F_6$, $C_3F_8$, $SF_6$ or another gas and oxygen as the etching gases is preferred since the through-hole 13 can thereby be formed at a low temperature without electrical damage to the Si substrate 1.

Figure 4G:
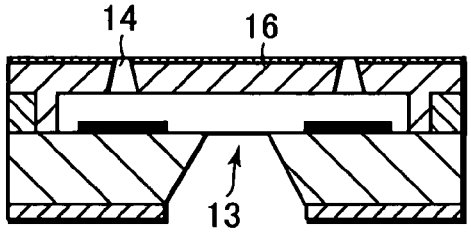

Subsequently, as shown in FIG. 4G, the portion of the Cu film 10 located in the region for forming the ink flow path 16 and the discharge opening patterns 10*a* are dissolved and eluted by an etching solution such as nitric acid, introduced from the discharge openings 14 and/or the through-hole 13, by means of which the SiC film 8 forms the ink flow path 16. Thereafter, an ink supply member (not shown) is bonded to the lower surface of the Si substrate 1 to complete the ink jet recording head.

The SiC film 8 is used as a basic material for forming the discharge openings 14 and the ink flow path 16 in this embodiment. Similarly to the $SiO_2$ film, the SiC film 8 is also relatively low in the coefficient of thermal expansion and relatively hard in comparison with resin. Therefore, it is resistant to deformation. In addition, similarly to $SiO_2$, SiC is superior to SiN and Ni in resistance to erosion by ink. Moreover, unlike resin, the SiC film 8 also prevents permeation of ink and therefore does not cause the problem of the liquid flow paths or discharge openings becoming narrowed due to swelling.

Furthermore, by leaving the Cu film 10 as a metallic material layer in the regions other than the ink flow path 16, a force applied to the Cu film 10 by a residual stress in the SiC film 8 can be offset by a force applied to the SiC film 8 by a residual stress in the Cu film 10, thereby preventing these forces from reaching the Si substrate 1 to cause warpage thereof. By virtue of this, the ink discharge precision can be further improved.

As stated hereinabove, according to this embodiment, it is possible to provide an ink jet recording head in which a short distance between the ink discharge pressure generating element and the discharge opening may be set with extremely high accuracy and precision as well as good reproducibility without any erosion caused by ink, and which is also capable of high grade recording, and a method of manufacturing the same.

While the above embodiments have been described by giving an example of using $SiO_2$ or SiC to form the ink flow path member, their chemical compound, carbon doped silicon oxide (SiOC), is also applicable, instead of these materials.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-041312 filed Feb. 18, 2004, which is hereby incorporated by reference herein.

What is claimed is:

1. A liquid discharge head, comprising:

a substrate having a plurality of liquid discharge elements formed thereon; and a liquid flow path member formed on a surface where the liquid discharge elements of the substrate are arranged, the liquid flow path member forming a plurality of liquid discharge openings and a plurality of liquid flow paths communicating with the plurality of liquid discharge openings, wherein the liquid flow path member is formed of at least one of silicon carbide, and SiOC.

2. A liquid discharge head according to claim 1, wherein the liquid discharge openings are formed by reactive ion etching.

3. A liquid discharge head according to claim 1, wherein the liquid discharge elements are electrothermal converting elements.

4. A liquid discharge head comprising:

a substrate having a plurality of liquid discharge elements formed thereon; and a liquid flow path member formed on a surface where the liquid discharge elements of the substrate are arranged, the liquid flow path member forming a plurality of liquid discharge openings and a plurality of liquid flow paths communicating with the plurality of liquid discharge openings, wherein the liquid flow path member is formed of at least one of silicon oxide, silicon carbide, and SiOC, and wherein a metallic material layer is formed between the substrate and a part of the liquid flow path member.

* * * * *